US005088508A

United States Patent [19]

Duncan

[11] Patent Number: 5,088,508

[45] Date of Patent: Feb. 18, 1992

[54] APPARATUS AND METHOD FOR ELIMINATING CIGARETTE SIDESTREAM SMOKE

[76] Inventor: Steven A. Duncan, 8606-B Mesa Dr., Austin, Tex. 78759

[21] Appl. No.: 656,768

[22] Filed: Feb. 15, 1991

[51] Int. Cl.[5] ..... A24F 19/00

[52] U.S. Cl. ..... 131/330; 131/201; 131/231; 131/242; 55/385.8

[58] Field of Search ..... 131/329, 330, 200–202, 131/231, 240.1, 241, 242; 55/134, 331, 385.8, DIG. 30

[56] References Cited

U.S. PATENT DOCUMENTS 4,154,251 5/1979 Doyel ..... 131/231

FOREIGN PATENT DOCUMENTS 2113069 8/1983 United Kingdom ..... 131/201

*Primary Examiner*—V. Millin
*Assistant Examiner*—J. Doyle
*Attorney, Agent, or Firm*—Shaffer & Culbertson

[57] ABSTRACT

An apparatus for eliminating sidestream smoke from a cigarette or other smoking article includes a smoke collecting chamber adapted to collect sidestream smoke from the lit end of the smoking article along with air for combustion of the sidestream smoke and to direct the mixture of sidestream smoke and air to a combustion area associated with the smoke collecting chamber. An ignition device is included in the apparatus for igniting at least a portion of the sidestream smoke received in the combustion area by heating the smoke in the combustion area to an ignition temperature. The preferred ignition device includes a heat source for constantly producing a flame in the combustion area. The apparatus may also include a smoke particle capturing arrangement in a capture chamber connected to the smoke collecting chamber. The smoke particle capturing arrangement is adapted to remove smoke particles from the sidestream smoke or to capture smoke particles in the combustion area on a suitable ignition surface so that the igniting device may ignite the captured smoke particles.

20 Claims, 2 Drawing Sheets

APPARATUS AND METHOD FOR ELIMINATING CIGARETTE SIDESTREAM SMOKE

BACKGROUND OF THE INVENTION

This invention relates to devices for reducing the harmful effects of cigarette smoke, and particularly, to devices and methods for eliminating sidestream smoke from a cigarette or other smoking article.

Recent studies indicate that cigarette smoking can have very serious health consequences even to those who choose not to smoke. One health risk to non-smokers arises from their inhaling secondary smoke produced as another person smokes a cigarette or other smoking article.

There are two types of secondary smoke. The first type of secondary smoke comprises smoke that is first inhaled into the smoker's lungs and then exhaled. A substantial portion of the harmful chemicals and particulate matter in the inhaled smoke is adsorbed or deposited in the smoker's lungs, mouth, and throat tissue as the smoke passes over the tissue. Thus, this exhaled secondary smoke has been partially cleaned at the expense of the smoker's lungs, mouth, and throat. The second type of secondary smoke is produced from the coal of the cigarette or other smoking article between times when the smoker inhales, or as the smoker inhales. A large portion of this smoke, which is referred to as sidestream smoke, is produced while the cigarette is being held by the smoker or while the cigarette or other smoking article is resting in an ashtray. Sidestream smoke is even more harmful than exhaled smoke because it is not partially cleaned by passing through the smoker's lungs. Furthermore, at times when the cigarette is simply being held or is resting in an ash tray, the combustion process at the cigarette coal is very inefficient and leaves many harmful particulates and gasses in the sidestream smoke.

A number of devices have been used to remove secondary smoke from smoking areas. One effective method for reducing the effects of secondary smoke was simply to thoroughly ventilate an area where smoking was allowed. Ventilating even relatively small areas, however, required large blowers for drawing smoke-laden air from the area and input vents allowing the influx of fresh air. Not only were the blowers expensive and often noisy, ventilation to remove secondary smoke was very inefficient where area heating or cooling was required.

Another method for reducing the effects of secondary smoke was to draw the secondary smoke-laden air through or over a suitable filter medium to filter particulates from the smoke. However, filter devices also required a high volume blower to draw smoke-laden air through the filter medium and thus were often noisy and quite expensive. Furthermore, recirculating filter units only removed particulate matter from the secondary smoke. Also, since such devices did not eliminate smoke at the source, the secondary smoke could not necessarily be cleaned with the filter device before it was inhaled and the harm done.

SUMMARY OF THE INVENTION

It is therefore a general object of the invention to provide an apparatus for eliminating sidestream smoke that overcomes the problems described above and other problems and deficiencies associated with prior devices for reducing the harmful effects of secondary smoke. It is also a general object of the invention to provide a method for eliminating sidestream smoke.

Pursuant to the object of the invention, an apparatus for eliminating sidestream smoke includes means for collecting smoke from the lit end or coal of a smoking article along with a volume of air sufficient for combusting the collected smoke. The apparatus also includes a combustion area adapted to receive the smoke and air mixture, and means for igniting the smoke in the combustion area. In operation, the smoke collecting means collects the smoke and air and directs the mixture to the combustion area where the smoke is ignited. Igniting the smoke reduces the harmful particulate and gaseous material in the collected smoke to its less offensive and relatively innocuous combustion products.

In the preferred form of the invention the smoke collecting means includes a smoke collecting chamber adapted to connect over a base so as to leave receptacle openings between the smoke collecting chamber and base. The receptacle openings are adapted to receive the lit end or coal of the smoking article. The smoke collecting chamber preferably tapers from the lower end connected to the base to a relatively narrow cross-sectional area portion adapted to direct and accelerate the collected smoke and air mixture to the combustion area.

The combustion area is preferably associated with or formed by a combustion chamber mounted above the smoke collecting chamber. In one preferred form, a paraffin candle or a butane-powered fuel cell mounted in the combustion chamber forms the ignition means. The preferred candle, fuel cell, or other heat source produces a flame in the combustion area that draws smoke and air upwardly from the smoke collecting chamber and raises the temperature of the smoke in the combustion area to an ignition temperature. Also, the flame is preferably positioned to help block smoke from exiting the combustion area.

Alternatively to, or preferably, in addition to igniting a portion of the sidestream smoke, the apparatus according to the invention may include smoke particle capture means for capturing smoke particles that are not ignited by the ignition means. In one preferred form of the invention, the capture means includes a specially shaped combustion chamber or capture chamber connected to a top portion of the smoke collecting chamber and having therein means for circulating or directing at least a portion of the smoke over a depositional surface as the heat source draws smoke and air from the smoke collecting chamber. As the smoke is circulated over the depositional surface, larger particulates in the smoke cool and are deposited on the depositional surface. Thus, the preferred sidestream smoke eliminating device according to the invention not only actually destroys sidestream smoke by reducing it to its less harmful combustion products, it also captures smoke particles that are not so ignited. Furthermore, both the smoke destroying function and the smoke capturing function are performed at the source of the sidestream smoke and before the smoke may be inhaled.

In another preferred form of the invention, the capture means comprises a capture material actually mounted in the combustion area and adapted to capture or collect smoke particles from the sidestream smoke as the smoke and air passes through the combustion area. In this form of the invention the ignition means is adapted to raise the surface temperature of the capture material, along with any smoke particles collected thereon, to the ignition temperature for effectively incinerating the captured smoke particles.

The method of eliminating sidestream smoke according to the invention includes collecting the sidestream smoke with air for combustion of the smoke, and then directing the collected smoke and air to a combustion area. The method then includes igniting at least a portion of the sidestream smoke received in the combustion area to reduce the smoke to its less harmful combustion products.

The method also includes the step of capturing smoke particles from the smoke directed to the combustion area. In one form of the invention the method includes circulating the collected smoke over the depositional surface upon which the particles eventually collect. An alternate method includes capturing the smoke particles on an ignition surface of the capture material in the combustion area and heating the ignition surface to an ignition temperature at which the collected smoke particles may ignite.

These and other objects, advantages, and features of the invention will be apparent from the following description of the preferred embodiments, considered along with the accompanying drawings.

DESCRIPTION OF THE PREFERRED EMBODIMENTS

Figure 2:
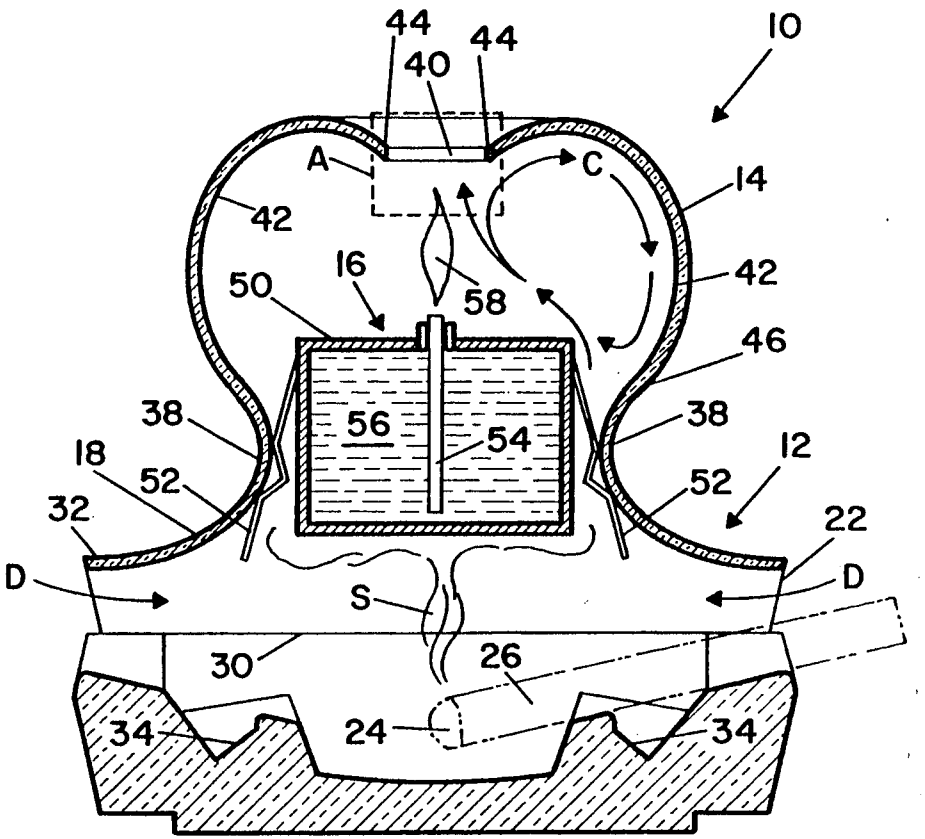
FIG. 2 is a view in longitudinal section taken along line 2—2 in FIG. 1.
Figure 1:
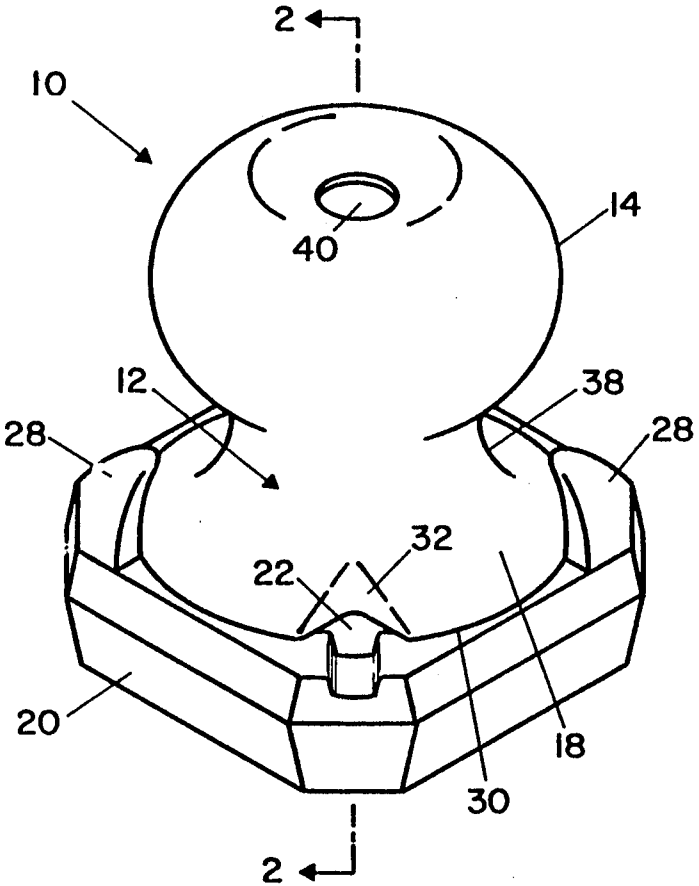
FIG. 1 is a view in perspective of a sidestream smoke eliminating apparatus embodying the principles of the invention.

FIGS. 1 and 2 show a cigarette sidestream smoke eliminating apparatus 10 embodying the principles of the invention. Although the apparatus 10 shown in the drawings in adapted particularly for use in eliminating sidestream smoke from cigarettes, those skilled in the art will readily appreciate that the apparatus according to the invention may be used with other types of smoking articles including cigars and pipes in addition to cigarettes. Regardless of the particular smoking article, the preferred form of the device 10 includes smoke collecting means 12, a combustion area A (FIG. 2), in this case associated with a combustion or capture chamber 14, and ignition means 16.

The smoke collecting means 12 comprises a smoke collecting chamber 18 mounted over a base member 20. Receptacle openings 22 are formed at the connection between the smoke collecting chamber 18 and the base 20 for receiving the lit end or coal 24 of the smoking article, in this case cigarette 26 (FIG. 2). The receptacle openings 22 are also somewhat larger than required to receive the cigarette 26 to allow air to flow around the cigarette to enter the smoke collecting chamber 18. The base member 20 includes flanges 28 which cooperate with the lower edge 30 of the smoke collecting chamber 18 to retain the base and smoke collecting chamber in the connected position shown in FIGS. 1 and 2. Raised portions 32 are associated with the receptacle openings 22 formed at the lower edge 30 of the smoke collecting chamber 18, and these raised portions may be aligned with the flanges 28 formed on the base 20 to allow the smoke collecting chamber to be separated from the base. Also, in the preferred form of the invention shown in FIG. 2, the base 20 includes indentations 34 associated with each receptacle opening 22. The indentations 34 provide a convenient structure for putting out a cigarette received in the device 10.

In the form of the invention shown in FIGS. 1 and 2, the capture chamber 14 is connected to an upper constricted or narrow cross-section portion 38 of the smoke collecting chamber 18. An exhaust opening 40 is formed generally in the top and center of the capture chamber 14. The illustrated capture chamber 14 also includes circulating means comprising a concave circulating surface 42 extending radially away from a diverting edge 44 of the exhaust opening and downwardly to a lower portion 46 of the capture chamber connected to the constricted portion 38 of the smoke collecting chamber 18. As shown in FIG. 2, the diverting edge 44 extends into the combustion area A.

The preferred ignition means 16 is shown best in FIG. 2 and comprises a butane or paraffin fuel cell 50 held by fuel cell support members 52 which are biased outwardly to contact the constricted portion 38 of the smoke collecting chamber 18. A suitable wick 54 extends into the fuel 56 contained in the fuel cell 50 and extends above the top of the fuel cell in position to produce a flame 58 adapted to increase the temperature in the combustion area A to an ignition temperature at which cigarette smoke particles in the combustion area may ignite.

Although a number of materials may be used for the various components of the apparatus 10 shown in FIGS. 1 and 2, the capture chamber 14, smoke collecting chamber 18 and base 20 are all preferably formed from glass or a similar material. The capture chamber 14 and smoke collecting chamber 18 are preferably formed in one piece to reduce the number of pieces to the apparatus and to prevent leakage that could occur if the chambers were separately formed. The illustrated preferred butane or paraffin fuel cell 50 is cylindrical in shape and may be made from a plastic material with a protective metal shield at its bottom surface and a metal cap holding the exposed wick 54. The fuel cell support members 52 may be plastic and integrally formed with the body of the fuel cell 50. The clearance between the fuel cell 50 and the constricted portion 38 of the smoke collecting chamber is preferably about one-eighth of an inch on all sides to provide the desired smoke and air acceleration. Also, although a butane or paraffin fuel cell is preferred, other types of heat sources such as electrical resistive elements may be employed to heat the combustion area to the desired ignition temperature and draw smoke and air to the combustion area.

The operation of the sidestream smoke eliminating apparatus 10 shown in FIGS. 1 and 2 and the method of the invention includes first collecting sidestream smoke S from the lit end or coal 24 of the cigarette 26 or other smoking article and then directing the collected smoke and air to the combustion area A. The method then includes igniting at least a portion of the smoke received in the combustion area A to reduce the smoke to its relatively harmless combustion products. These combustion products may exit the apparatus through the exhaust opening 40.

As indicated at the arrows D, air is constantly drawn in through the receptacle openings 22 by the flame 58 of the ignition means 16. This drawing action by the ignition means 16 not only helps to mix the cigarette smoke S with air but also prevents smoke from exiting through the receptacle openings 22. Actual ignition of the smoke received in the combustion area A is accomplished by maintaining the combustion area A at the ignition temperature for the smoke particles using the heat from the burning fuel 56.

The method of the invention also includes the step of capturing smoke particles from the smoke directed to the combustion area A. In the embodiment shown FIGS. 1 and 2, this step is performed by the particular shape of the capture chamber 14 and the position of the diverting edge 44 with respect to the combustion area A. A portion of the smoke drawn up from the smoke collecting chamber 18 to the combustion area A is diverted by the diverting edge 44 as indicated by arrows C so as to follow the concave circulating surface 42 outwardly and downwardly and then back into the incoming stream of smoke and air. Thus, a portion of the smoke is caught in a circulating pattern in which the smoke particles circulate repeatedly through the combustion area A and then across the concave circulating surface 42. The concave surface 42 forms a depositional surface on which the circulating smoke particles may eventually deposit unless ignited in the combustion area A. The inner surface of the smoke collecting chamber 18 also forms a depositional surface upon which smoke particles may collect.

Figure 3:
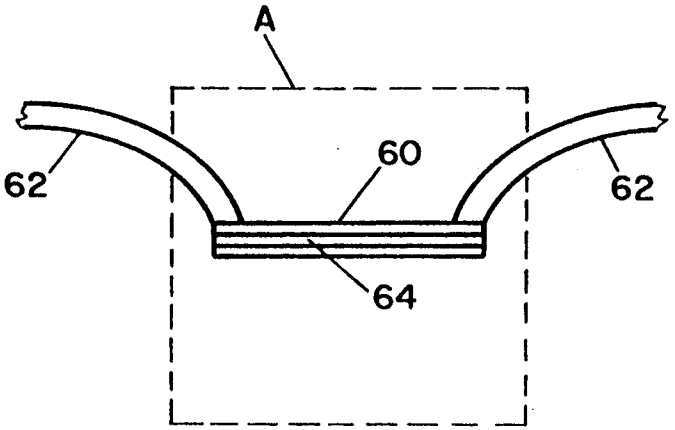
FIG. 3 is an enlarged, partially diagrammatic view in section showing an alternate smoke particle capture means.

FIG. 3 shows the exhaust opening 60 and a portion of the circulating surface 62 of a form of the invention that includes an alternate smoke particle capture means in addition to the circulating surface. In this alternate form of the invention a gas permeable capture material 64 is located within the combustion area A in position to collect passing smoke particles (not shown) on its surface. With the capture material 64 positioned in the combustion area A, a heat source such as the butane heat source shown in FIG. 2 heats the surface of the capture material to the ignition temperature to ignite the smoke particles collected on the material. The capture material 64 preferably comprises several layers of a fine wire mesh fastened by suitable means to the exhaust opening 60.

Figure 4:
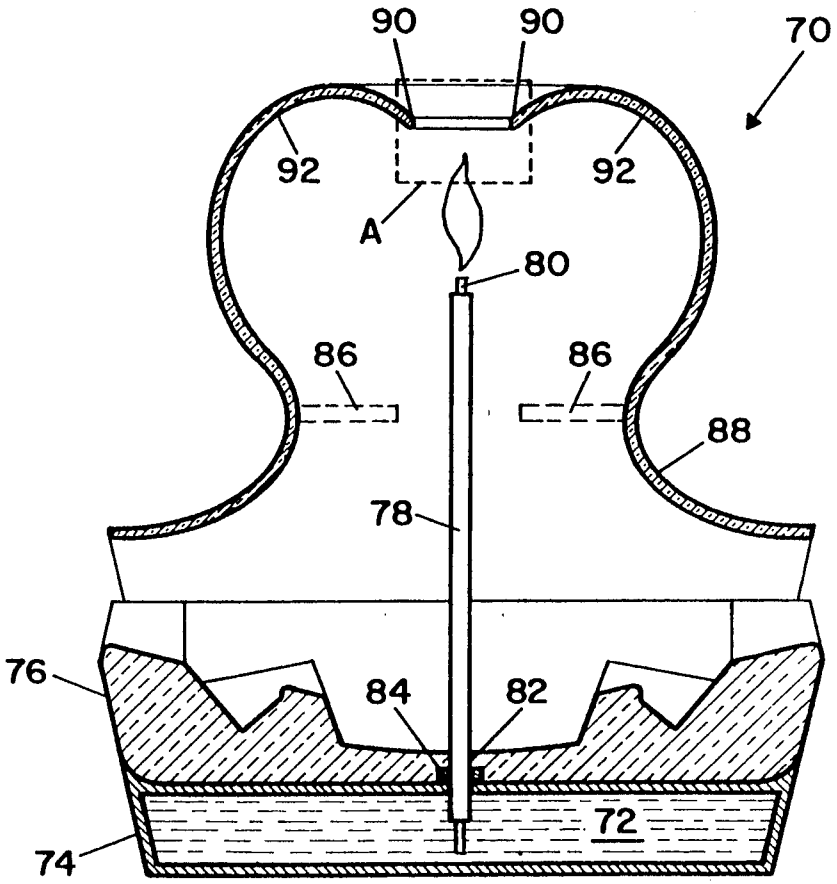
FIG. 4 is a view in longitudinal section similar to FIG. 2 but showing a sidestream smoke eliminating apparatus embodying the principles of the invention having an alternate fuel cell arrangement.

FIG. 4 shows another alternate sidestream smoke eliminating apparatus 70 embodying the principles of the invention. This form of the invention includes an alternate fuel cell placement and is adapted particularly for increased volume fuel cells and thus longer operation between fuel cell replacement or refill. In this alternate form of the invention, the fuel 72 is contained in a lower base portion 74 which may be separated from an upper base portion 76 that performs the function of the base 20 shown in FIGS. 1 and 2. A wick conduit 78 extends upwardly from the fuel cell lower base 74 to expose a wick 80 adjacent to the combustion area A similarly to the form of the invention shown in FIGS. 1 and 2. The wick conduit 78 extends through an opening 82 formed in the bottom of the upper base portion 76 and a suitable o-ring seal 84 is positioned at the base of the wick conduit between the upper and lower base portions. Also, a baffle 86 is positioned in the constricted portion of the alternate smoke collecting chamber 88 to further reduce the flow area and produce the desired smoke and air acceleration toward the combustion area A, diverting edge 90, and circulating surface 92. The fuel 72 may be butane and the base/fuel cell 74 may also have refill ports (not shown) such as those commonly used with cigarette lighters.

The above described preferred embodiments are intended to illustrate the principles of the invention, but not to limit the scope of the invention. Various other embodiments and modifications to these preferred embodiments may be made by those skilled in the art without departing from the scope of the following claims. For example, although the smoke collecting and combustion/capture chambers, 18 and 14 respectively, are preferably formed in one piece, they may be separately formed and connected by suitable means. Also, the combustion/capture chamber 14 need not have the preferred bell shape shown in the figures.

I claim:

1. An apparatus for eliminating sidestream smoke from a cigarette or other smoking article, the apparatus comprising:

(a) smoke collecting means for collecting sidestream smoke from a lit end of a smoking article and air for combustion of the collected sidestream smoke;

(b) a combustion area associated with the smoke collecting means for receiving smoke and air collected by the smoke collecting means; and (c) ignition means for igniting at least a portion of the sidestream smoke received in the combustion area.

2. The apparatus of claim 1 further comprising receptacle means for receiving the lit end of the smoking article, and wherein the smoke collecting means is adapted for collecting sidestream smoke from the smoking article received in the receptacle means.

3. The apparatus of claim 2 wherein the ignition means comprises:

(a) a heat source capable of drawing smoke and air from the smoke collecting means to the combustion area and raising the temperature of at least a portion of the smoke received in the combustion area to an ignition temperature at which said portion of smoke may ignite.

4. The apparatus of claim 3 further including:

(a) smoke particle capture means connected to the smoke collecting means for receiving smoke from the smoke collecting means and for capturing smoke particles contained in the smoke on a depositional surface.

5. The apparatus of claim 4 wherein the smoke particle capture means comprises:

(a) a capture chamber connected to the smoke collecting means for receiving smoke and air collected by the smoke collecting means and having the depositional surface positioned therein; and (b) circulating means within the capture chamber for circulating at least some of the smoke received from the smoke collecting means over the depositional surface as the heat source draws said smoke and air to the combustion area so that smoke particles may be deposited on the depositional surface.

6. The apparatus of claim 5 wherein the circulating means comprises:

(a) a concave circulating surface within the capture chamber; and (b) a diverting edge of the circulating surface positioned within the combustion area so as to divert at least some of the smoke received from the smoke collecting means across the concave surface.

7. The apparatus of claim 6 wherein:

(a) the diverting edge extends around substantially the entire lateral perimeter of the combustion area; and (b) the concave circulating surface extends radially away from the combustion area around substantially the entire lateral perimeter of the combustion area.

8. The apparatus of claim 7 wherein:

(a) the smoke collecting means comprises a smoke collecting chamber with an upper smoke channelling section with a reduced cross-sectional area;

(b) the capture chamber is connected at a lower edge to the smoke channelling section of the smoke collecting means;

(c) the concave circulating surface comprises the inner surface of an upper portion of the capture chamber; and (d) the depositional surface comprises the concave circulating surface.

9. The apparatus of claim 8 further including a base member over which the smoke collecting chamber is adapted to connect, and wherein the receptacle means comprises an opening formed in the lower edge of the smoke collecting chamber and in the base member, the opening being capable of receiving the lit end of the smoking article and also being large enough to allow air to be drawn therethrough by the heat source when the smoking article is received therein.

10. The apparatus of claim 9 wherein the heat source is positioned in the capture chamber and is adapted to produce a flame generally in the combustion area.

11. The apparatus of claim 4 wherein:

(a) the capture means comprises a capture material mounted in the combustion area, the capture material for capturing smoke particles as smoke and air pass through the combustion area; and (b) the ignition means is adapted to raise the temperature at the surface of the capture material to the ignition temperature

12. An apparatus for capturing sidestream smoke from a cigarette or other smoking article, the apparatus comprising:

(a) receptacle means for receiving a lit end of a smoking article;

(b) smoke collecting means mounted above the receptacle means for collecting sidestream smoke from the lit end of the smoking article received in the receptacle means;

(c) a capture chamber mounted above the smoke collecting means for receiving smoke collected by the smoke collecting means, the smoke being directed by the smoke collecting means to a diverting area within the capture chamber;

(d) a depositional surface positioned within the capture chamber; and (e) circulating means mounted within the capture chamber for circulating at least some of the smoke from the smoke collecting means over the depositional surface so that smoke particles within the smoke may be deposited on the depositional surface.

13. The apparatus of claim 12 wherein the circulating means comprises:

(a) a concave circulating surface positioned within the capture chamber; and (b) a diverting edge of the circulating surface positioned within the diverting area of the capture chamber for diverting smoke directed to the diverting area so that said diverted smoke flows over the concave circulating surface.

14. The apparatus of claim 13 wherein the concave circulating surface is the depositional surface.

15. A method for eliminating sidestream smoke from a cigarette or other smoking article comprising the steps of:

(a) collecting sidestream smoke from a lit end of a smoking article with air for combustion of the collected sidestream smoke;

(b) directing the collected smoke and air to a combustion area; and (c) igniting at least a portion of the sidestream smoke received in the combustion area.

16. The method of claim 15 further including the step of:

(a) capturing smoke particles from the smoke directed to the combustion area on a capture surface.

17. The method of claim 16 wherein the step of capturing smoke particles includes the step of:

(a) circulating a portion of the smoke over a depositional surface.

18. The method of claim 16 wherein the step of capturing the smoke particles includes the step of:

(a) capturing the smoke particles on an ignition surface in the combustion area.

19. The method of claim 18 wherein the step of igniting the sidestream smoke received in the combustion area includes the step of:

(a) heating the ignition surface in the combustion area to an ignition temperature at which the smoke particles residing on the ignition surface may combust.

20. The method of claim 15 wherein the step of igniting the sidestream smoke received in the combustion area includes the step of:

(a) heating at least a portion of the sidestream smoke received in the combustion area to an ignition temperature with a flame produced generally in the combustion area.

* * * * *